United States Patent [19]

Trygg

[11] 4,343,336

[45] Aug. 10, 1982

[54] LIQUID DISPENSING DEVICE

[76] Inventor: Lars E. Trygg, Villa Solvik 310, S-770 13 Grangärde, Sweden

[21] Appl. No.: 192,116

[22] Filed: Nov. 6, 1979

Related U.S. Application Data

[63] Continuation-in-part of Ser. No. 171,232, Sep. 24, 1979, Pat. No. 4,331,187.

[51] Int. Cl.[3] ..... B65B 57/14

[52] U.S. Cl. ..... 141/218; 141/206; 222/52

[58] Field of Search ..... 141/198, 206–229; 222/52

[56] References Cited

U.S. PATENT DOCUMENTS 3,077,212 2/1963 Hearn ..... 141/209

3,603,359 9/1971 Belue ..... 141/208

*Primary Examiner*—Frederick R. Schmidt

*Attorney, Agent, or Firm*—Sughrue, Mion, Zinn, Macpeak and Seas

[57] ABSTRACT

A liquid dispensing device in the form of a so-called piston valve for use with a gasoline pump comprises a valve housing having an inlet connected to the pump and an outlet; a valve for controlling the flow of liquid from the inlet to the outlet; a discharge pipe connected to said outlet; and a manually operable operating mechanism for controlling movement of said valve, which operating mechanism comprises adjustable means which can be moved between an engagement position and a free position. In order to avoid the risk of unexpected flow of gasoline when the pump is activated, the movement of the adjustable means between said free position and said engagement position is arranged to take place in dependence upon the pressure of the gasoline at the inlet, and passage means are arranged for equalizing the overpressure at the inlet when the pump is deactivated when the valve is open or if an attempt is made to open the valve when the pump is deactivated and said pressure is sufficient to move the adjustable means.

9 Claims, 9 Drawing Figures

LIQUID DISPENSING DEVICE

This application is a continuation-in-part of application Ser. No. 171,232 filed Sept. 24, 1979, now U.S. Pat. No. 4,331,187.

The present invention relates to a liquid dispensing device, and particularly to a device having the form of a so-called pistol nozzle or pistol valve, such nozzles or valves normally being used in association with petrol pumps at vehicle filling stations.

Such pistol valves comprise a valve housing having an inlet and an outlet, a valve for controlling the flow of liquid from the inlet to the outlet, a discharge pipe connected to the outlet, and a manually operable operating mechanism for controlling movement of the valve, said operating mechanism including adjustable means which can be adjusted or moved between an active or engagement position and an inactive or free position. The operating mechanism normally has the form of two plungers which are axially movable in the valve housing and one of which is arranged within the other. In the rest position, the outer plunger forces the valve into sealing abutment with a valve seating under the action of a relatively heavy spring. Each of the plungers is provided with a respective recess which lie opposite each other in said rest position. The inner plunger is moved axially by operating an outer operating handle. The outer plunger can be caused to accompany the inner plunger during said axial displacement thereof owing to the fact that in said rest position two rollers carried by a holder are urged downwardly through the recess in the outer plunger and into the recess in the inner plunger. Thus, in this position the rollers couple the two plungers together in a manner such that the outer plunger will accompany the axial movements of the inner plunger when the operating handle is activated. Such an axial displacement of the outer plunger allows the valve to be subsequently opened by an overpressure at the inlet.

In previously known pistol valves of this type, the holder carrying said rollers is normally spring biased towards its engagement position with said inner plunger. Thus, the handle need only be moved to the neutral position in order to be able open the valve, meaning that the recesses of the plungers are located opposite each other and that said rollers will be pressed into said recesses by means of said spring. Subsequent depression of the handle will cause the valve to open as soon as the requisite pressure prevails at the inlet.

The main function of the rollers is to permit the valve to close as soon as the level of liquid in the tank has reached a certain position on the discharge pipe of the pistol valve. To this end, the holder carrying said rollers is attached to a diaphragm which is arranged to curve upwardly to remove the rollers from the said engagement position with the inner plunger, when an underpressure is obtained in a chamber arranged above said diaphragm, said chamber communicating with an opening arranged at said position on the discharge pipe. If the handle is still held depressed, the inner plunger will remain in its axially displaced position while the outer plunger will be returned by its associated spring, thereby causing the valve to seal against its valve seating.

Pistol valves of this type thereby prevent overfilling of the tank, by automatically interrupting the flow of liquid thereto, and hence is manually serviced filling stations these pistol valves are normally provided with latching means by means of which the handle can be held depressed to permit filling of the tank to continue whilst the attendant carries out other servicing details on the vehicle. In the case of filling stations which are not serviced by skilled personnel and in which supervision of the pumps is of a relatively poor standard, the provision of means for latching the handle in the filling position is not permitted, since carelessness or acts of illwill can result in large quantities of petrol flowing out immediately a pump is actuated. For example, this can occur when the operating handle is depressed and latched in its depressed position by some person or other, subsequent to the pump being deactivated after a filling operation. This latching of the handle in its depressed position will cause the tension acting on the valve through the outer plunger to be relieved, and hence the valve will open as soon as the pump is started up.

This problem becomes more serious in the case of so-called cash petrol dispensers in which a filling operation is normally not terminated as a result of the petrol tank being filled, but as a result of the dispensement of a quantity of petrol corresponding to the amount of cash paid to the pump. When the handle of such a pump can be latched in its inpressed position, it is relatively easy for the motorist to forget to return the handle to its neutral position before placing the pistol valve back in its recess in the pump, since the handle need never be released in order to close the valve.

In order to avoid these problems it has been suggested that the pistol valve is constructed in a manner such that the valve is closed when the pressure of the liquid in the supply line falls beneath a given minimum value.

This is achieved with a liquid dispensing device according to the invention by the fact that movement of said means which are adjustable between an engagement position and a free position, said means in the above example having the form of rollers, is arranged to take place in dependence upon the pressure of the liquid at the inlet. Thus, the arrangement is such that the rollers cannot be pressed down into the recess in the inner plunger unless an overpressure prevails at the inlet, and such that the rollers return immediately to the inactive or free position as soon as the pressure at the inlet ceases. Thus, this means that the aforementioned rollers will return to the inoperative position when the required amount of petrol has been supplied to the petrol tank, and that they cannot be pressed down into the position of engagement with the inner plunger if the overpressure does not remain at the inlet or a new overpressure has built up after the pump has been deactivated.

In prior art pressure controlled pistol valves, however, subsequent to the valve having been closed, for example by (a) the automatic deactivation of the pump, (b) releasing the handle, or (c) by reason of the fact that the incoming flow of petrol has fallen to a minimum value, a pressure of such magnitude may remain or may be re-built up in the supply line, that when utilizing a re-setting mechanism of the aforedescribed type, the handle and valve can be latched in the inpressed position although the pump has been deactivated. Thus, the aforementioned risk of an unexpected flow of petrol from the filling nozzle when the pump is activated remains.

Another serious disadvantage with known piston valves is that the pressure in the supply line activates the valve mechanism via a membrane or diaphragm. When the pistol valve is to be used for dispensing petrol, the valve mechanism becomes excessively insensitive, resulting in an unreliable function. This is due to those materials which can be used for diaphragms which are to come into contact with petrol.

A main ojbect of the present invention is to provide a liquid-dispensing device in which the aforementioned disadvantages and accident risks are eliminated.

In accordance with the present invention the solution to the aforementioned problems lies in the fact that there shall not remain or be built-up at the inlet an overpressure of such magnitude as to enable the valve to be latched in the open position when the pump is deactivated.

In accordance with the present invention the problems are solved by providing means for equalizing the overpressure at said inlet when the pump is shut-off with the valve open, or if an attempt is made to open the valve when the pump is deactivated and said pressure is sufficient to move the aforementioned adjustable means of the valve mechanism.

In order to obtain a highly responsive and positive functioning when moving said adjustable means, it is preferred that the pressure of the liquid at said inlet is arranged to act on a piston connected with said adjustable means. Among other things, this will eliminate the problems resulting from the deficiencies of the conceivable materials from which the aforementioned diaphragm can be made.

In the case of cash petrol dispensers the capacity of the pump is limited resulting in a decreasing flow of petrol towards the end of a filling operation as the cash is used up. Since the device according to the invention, however, is based on the use of an overpressure at the inlet of the pistol valve, the pistol valve when used in cash petrol dispensers must be so constructed that it maintains a given pressure at said inlet. This can be achieved by constructing the valve in a manner such that the opening area of the valve is adapted to the incoming flow of petrol. Thus, the valve can be arranged to be opened by the pressure at the inlet against the action of a spring which determines said given pressure. Conveniently, the valve arrangement is constructed in a manner such that when the last mentioned spring tends to fully close the valve when said incoming flow ceases, there is obtained a small ventilating passage for equalizing the pressure at said inlet.

Other characterizing features of the invention are disclosed in the attached claims.

The invention will now be described more clearly with reference to the accompanying drawings.

Figure 1:
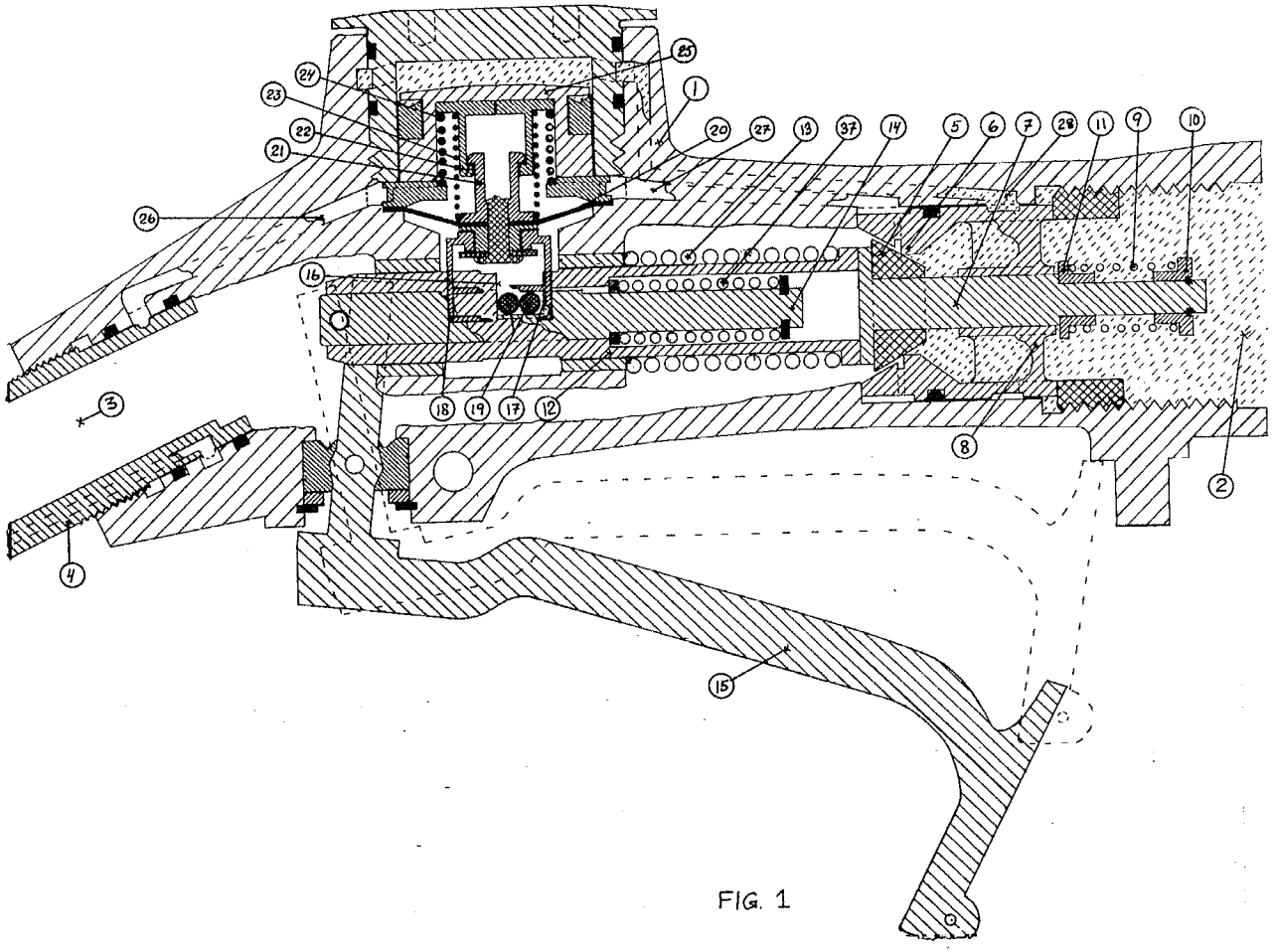
FIG. 1 is an axial sectional view of a pistol valve according to the invention ready to carry out a filling operation.

The pistol valve illustrated in FIG. 1 comprises a valve housing 1 having an inlet 2 and an outlet 3. The inlet 2 is connected with a hose (not shown) from a petrol pump, while the outlet 3 is connected to a discharge pipe 4. The valve housing 1 includes a valve body 5 which seals against a valve seating 6 and which is provided with a valve spindle 7. The spindle extends through a guide 8 and is provided at its rear end with a return spring 9, which operates between a stationary washer 10 and a displaceable washer 11.

It is assumed that the petrol pump is activated in the illustrated position, the inlet 2 being filled with petrol under pressure. The valve is held closed, however, by the fact that an axially displaceable cylindrical plunger 12 urges the valve body 5 against the valve seating 6 under the action of a spring 13, which counteracts the pressure at the inlet 2. An inner plunger 14 is arranged for axial movement in the cylindrical plunger 12. The inner plunger 14 can be displaced by pulling in the handle 15, as indicated in dash lines, and is provided with a return spring 37.

The plungers 12 and 14 can be coupled together in a manner such that the outer plunger 12 is caused to accompany the movement of the inner plunger 14. To this end, said plungers are each provided with a respective recess 16 and 17 in which two rollers 19 carried by a holder 18 can be introduced. The holder 18 is suspended from a diaphragm 20 which carries on its opposite side one part 21 of a telescopic claw or clutch mechanism 21, 22. The reference 23 identifies a spring which attempts to hold the telescopic mechanism in its outwardly extended state, while the reference 24 identifies a heavier spring which attempts, via the claw arrangement 21, 22 to lift both the diaphragm 20 and the holder 18 with the rollers 19 and, in addition, a piston 25.

Formed between the diaphragm 20 and the piston 25 is a closed chamber which is used in a conventional manner to close the valve 5 when the level of petrol in the tank has reached a given position on the discharge pipe 4. To this end, the chamber is arranged to communicate with a channel 26 having a mouth which opens at the outside of the discharge pipe 4 adjacent the end thereof, and with a corresponding channel 27 having a mouth which opens into the valve seating 6. As petrol flows through the valve opening, there is created at this last mentioned mouth an ejector effect which draws air through the channel 26, the chamber obtained between the diaphragm 20 and the piston 25, and the channel 27. The effect of this automatic protection against overfilling is as follows.

With the rollers 19 occupying the position illustrated in FIG. 1, the valve 5 can be opened by depressing the handle 15. The inner plunger 14 will be moved to the left in the figure and the outer plunger 12 will accompany the movement of the inner plunger 14 as a result of the coupling of said plungers by the rollers 19 and be moved to the left whilst compressing the spring 13. The load on the valve 5 is hereby released, whereupon the pressure at the inlet 2 is able to open the valve. Petrol will then flow through the valve and out through the discharge pipe 4, whereupon a certain suction effect is obtained through the channels 26 and 27 and intermediate chamber, as hereinbefore mentioned. When the level of petrol in the tank reaches the mouth of the channel 26 located adjacent the forward end of the discharge pipe, it is momentarily closed, thereby causing, as a result of said ejector action, an underpressure to be obtained in the chamber above the diaphragm 20. The diaphgram will thus be caused to curve upwardly whilst compressing the telescopic claw arrangement 21, 22. This causes the holder 18 to be lifted and the rollers 19 to be moved out of their position of engagement with the inner plunger 14. The outer plunger 12 will then be returned immediately, to close the valve 5, under the action of spring 13. The rollers 19 will also be entrained with said closing movement and cannot be pressed down into the recess of the inner plunger until the handle has been released.

In order, in accordance with the invention, to ensure that the pistol valve will not occupy its opened position when the petrol pump is deactivated, which would result in petrol being dispensed as soon as the pump is activated, the movement of the rollers 19 between their engagement position and free position shall take place in dependence upon the pressure at the inlet 2, in addition to the aforedescribed closing function. To this end a channel 28 is arranged between the inlet and the chamber above the piston 25. Thus, the piston will constantly be activated by a force which is directly proportional to the pressure at the inlet 2. Thus, as a result of the spring 24 the rollers 19 cannot be pressed down into engagement with the inner plunger 14 unless an overpressure prevails on the upper side of the piston 25. This ensures that the valve cannot be opened by depressing the handle 15 when no pressure prevails at the inlet 2. Similarly, this means that the rollers 19 are lifted up out of engagement with the inner plunger 14 as soon as the pressure at the inlet 2 ceases, since the spring 24 will then return the piston 25 to its upper position.

In order for petrol to be supplied through the pistol nozzle, the valve arrangement must be in the position illustrated in FIG. 1. Thus, the petrol pump shall be activated so that a pressure exists at the inlet 2, and the handle 15 must be located in its neutral position, which means that the recesses 16 and 17 of respective plungers 12 and 14 are located opposite each other. The pressure at the inlet 2 will then cause the holder 18, through the action of piston 25, to urge the rollers 19 into engagement with the inner plunger 14. When the handle 15 is then depressed, the inner plunger will be displaced carrying with it the outer plunger 12, which releases the valve 5 which can then be opened by the pressure at the inlet.

Figure 2:
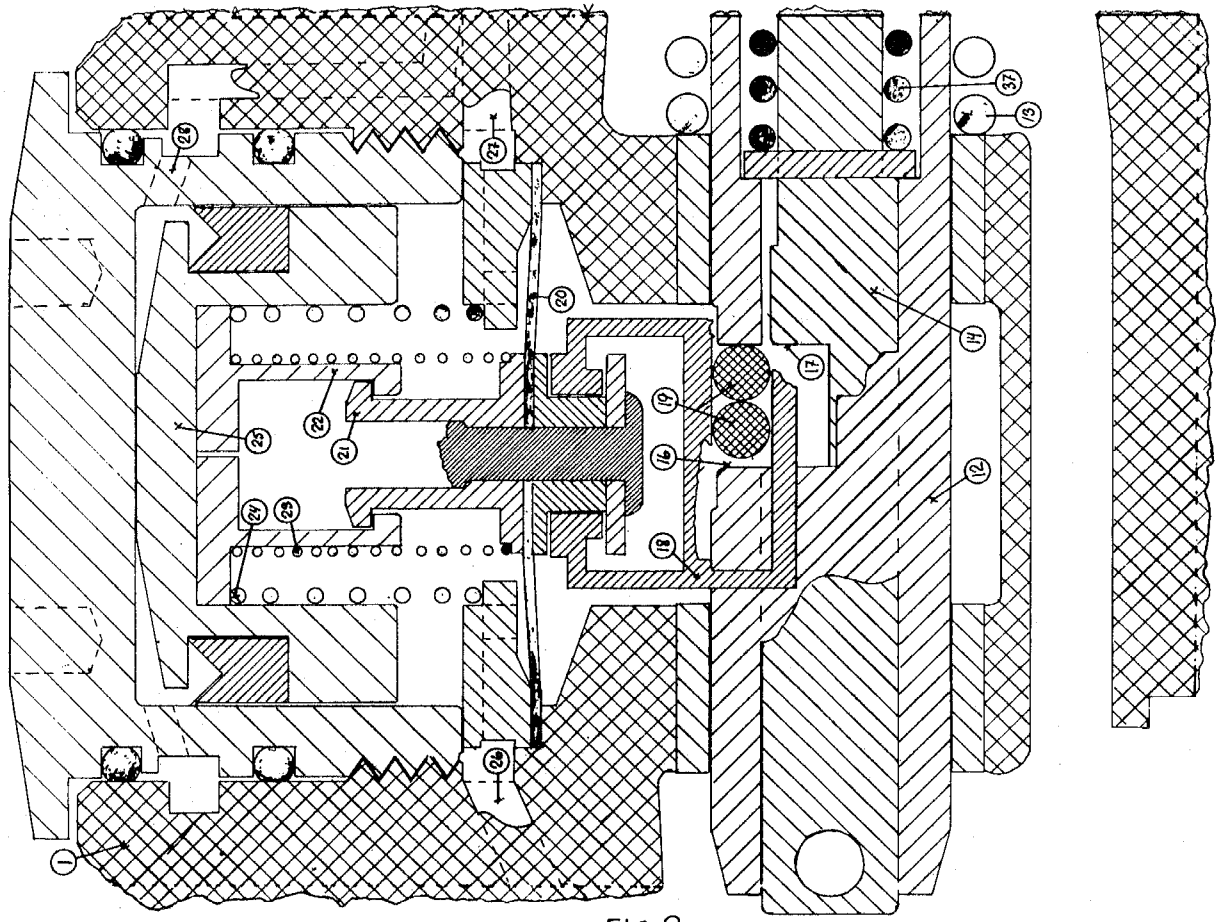
FIGS. 2–4 illustrate in larger scale other positions of the operating mechanism.

FIG. 2 illustrates the state obtained when no overpressure exists at the inlet 2. The spring 24 will then hold the piston 25 in its upper position, in which position the piston holds the diaphragm 20 and the holder 18 with rollers 19 in a lifted position, via the claw arrangement 21, 22. When the handle 15 is depressed in this position, the inner plunger 14 will be moved to the left, in the normal manner. The outer plunger 12 will not, however, accompany the movement of the inner plunger, and the valve cannot be opened.

Figure 3:
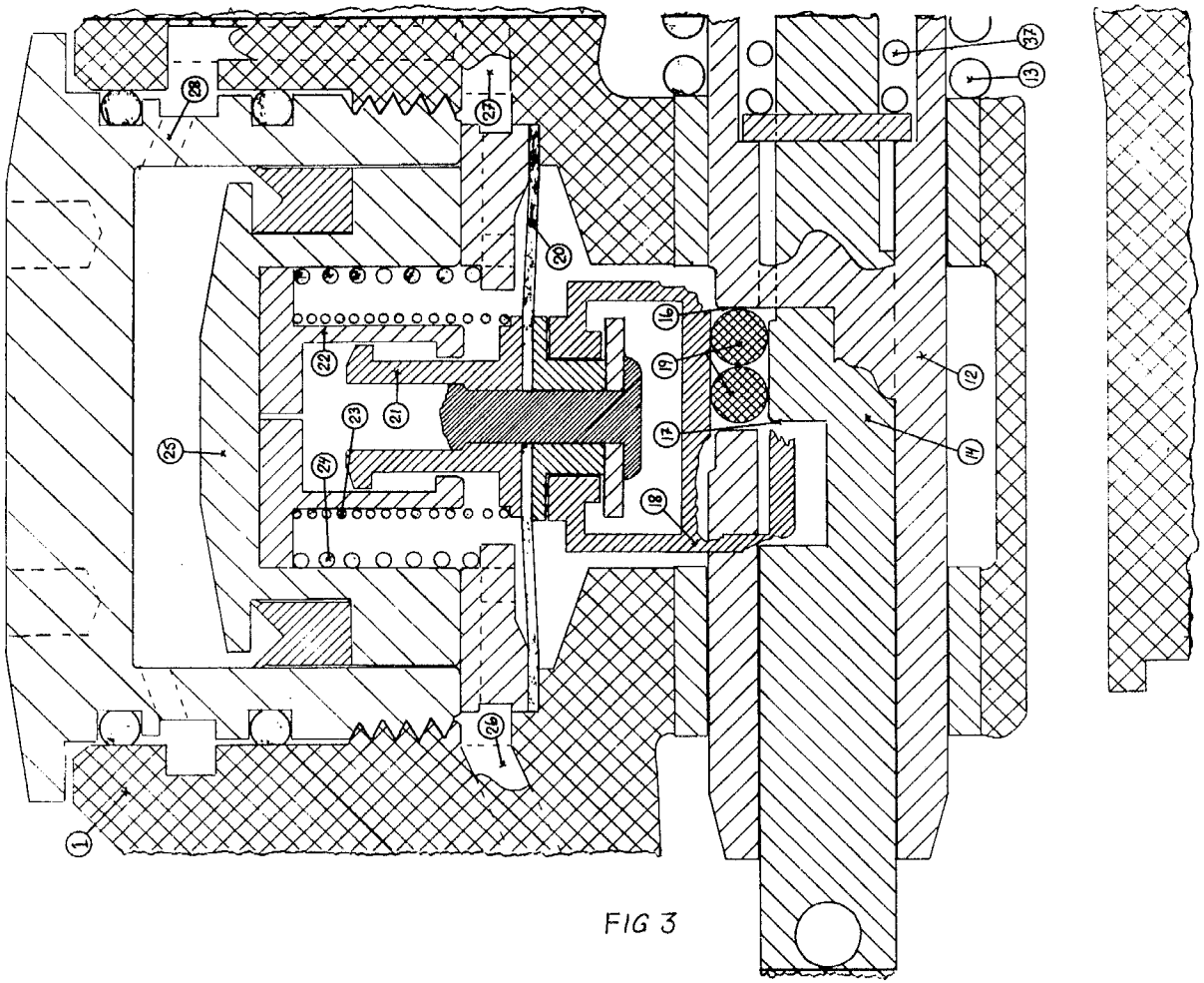

FIG. 3 illustrates the state obtained when the handle 15 is already depressed when the petrol pump is activated. As was the previous case, the pressure acting on the piston 25 will urge the piston down but since the inner plunger 14 has been moved forward by the depression of the handle, the recesses of the plungers will not be located opposite one and other. The rollers 19 can thus not be pressed into engagement with the inner plunger 14. Instead, movement of the piston 25 will cause the telescopic claw arrangement 20, 21 to be compressed. Thus, petrol cannot be dispensed until the handle 15 is released and re-depressed, causing the rollers to be pressed down into the recess 17 of the inner plunger 14.

Figure 4:
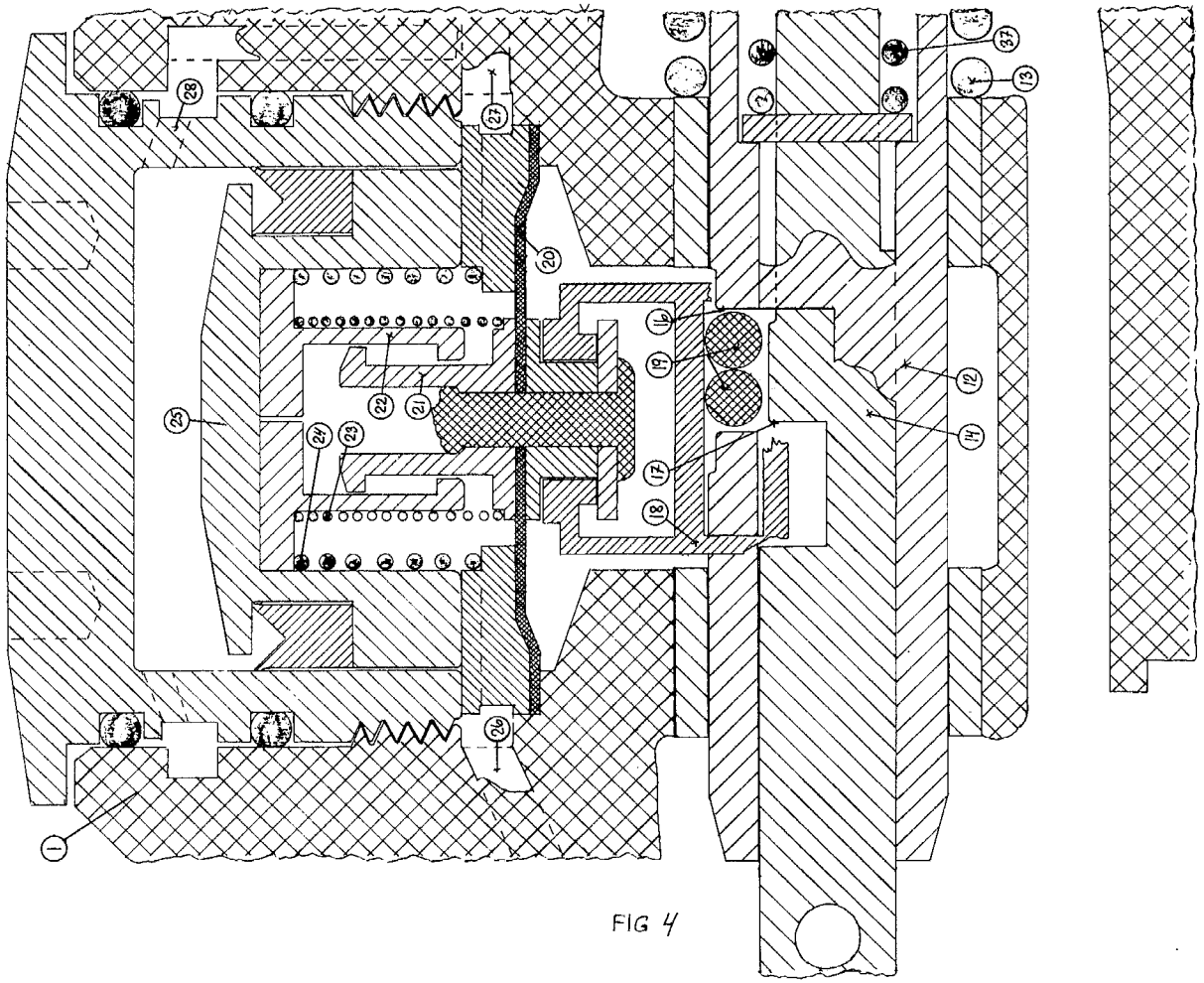

A position corresponding to that shown in FIG. 3 is also shown in FIG. 4, this position having been obtained as a result of the pump being automatically deactivated by a full tank. This is illustrated by the fact that the diaphragm 20 has been arched upwardly by the underpressure in the chamber between the diaphragm and the piston 25. This upward arching of the diaphragm has resulted in that the holder 18, with the rollers 19, have been drawn up out of engagement with the inner plunger 14 whilst compressing the telescopic claw arrangement 20, 21. The outer plunger 12 has then returned under the action of the spring 13 and closed the valve 5. Thus, it is also necessary in this case to first release the handle and then re-depress the same in order to dispense petrol from the pump.

In order to permit the pistol valve according to the invention to be used with cash petrol dispensers, in which the flow varies during a filling operation in a manner such as to be relatively small towards the end of said operation, or to be used with other pumps in which the flow varies, the valve arrangement is constructed in a manner such that a given minimum pressure constantly exists at the inlet during a dispensing operation. This given pressure shall correspond to the pressure required to urge the piston 25 downwardly. This can be achieved, for example, in the manner illustrated in FIGS. 5–7.

Figure 5:
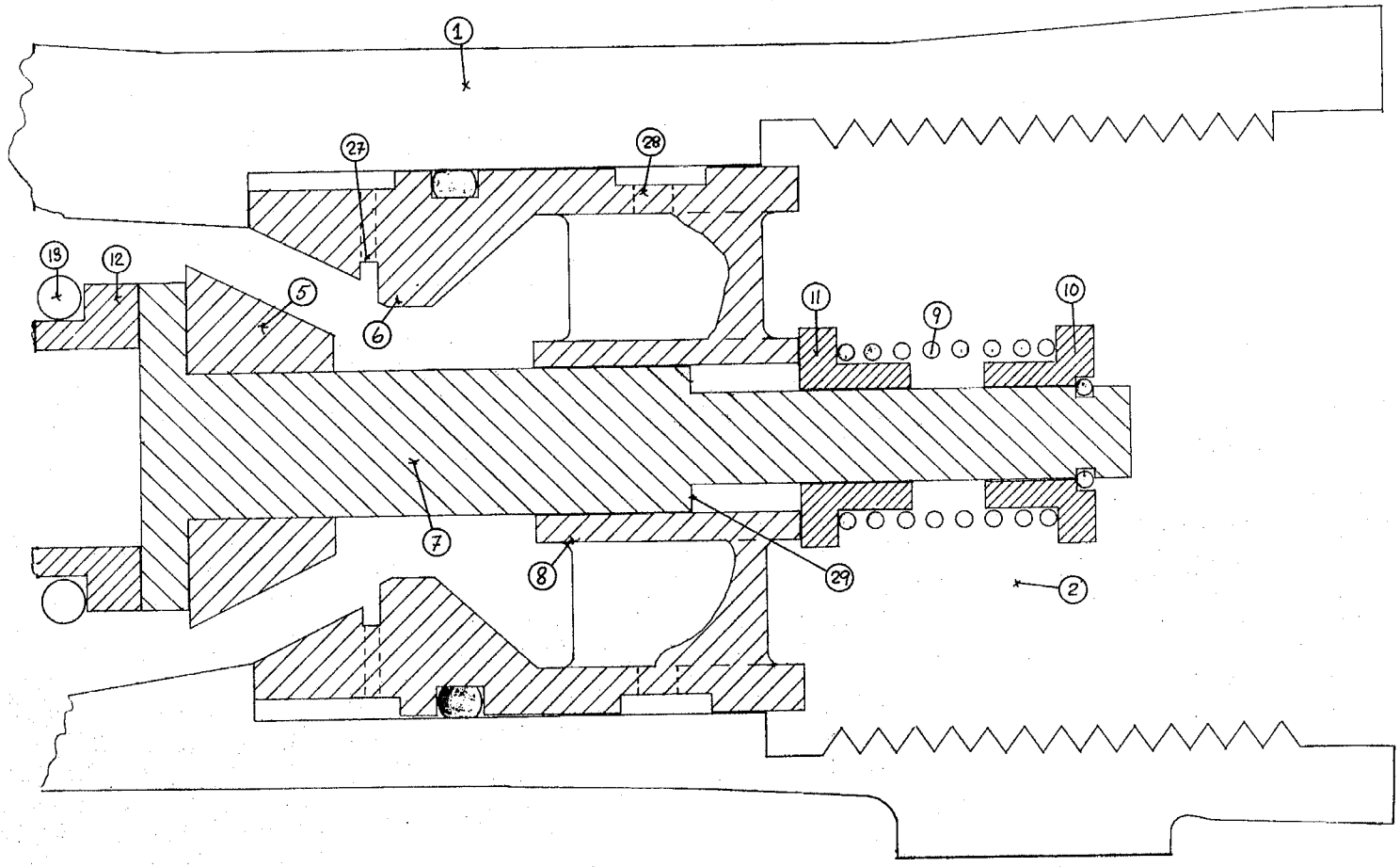
FIG. 5 illustrates the valve in a fully open position.

FIG. 5 illustrates the valve in its fully opened position, where contact exists with the end of the outer plunger 12. Opening of the valve takes place against the action of the spring 9, and as a result of the pressure at the inlet 2. When the incoming flow decreases, the pressure on the valve 5 will also decrease, which causes the return spring 9 to reduce the area of the valve opening in a manner such that a given minimum pressure, dependent upon the spring, will constantly exist at the inlet.

In all of the aforedescribed embodiments there is obtained an automatic closing the valve when the tank is full or when the incoming flow of petrol ceases. Further, the valve is closed when the handle 15 is released. When the flow of petrol is interrupted as a result of a full tank or because the handle has been released, the valve will be closed whilst the pump is still activated. This means that a full pressure will be built up in the hose and will remain whilst the pump is deactivated. Since this pressure acts on the piston 25, the valve can be opened and latched by depressing the handle 15. In the case, for example, of a cash petrol dispenser the valve will tend to close, in a corresponding manner before the pressure at the inlet has become so low that the rollers 19 are drawn up out of engagement with the inner plunger 14. This is due to the fact that the return spring 9 is dimensioned in a manner such that the input pressure is maintained at a valve sufficiently high to displace the piston 25. A corresponding effect can also be obtained when the hose passing to the pistol valve is filled with petrol under low pressure. In this case, however, the quantity of petrol in the hose may be heated by the sun so that the pressure increases to a value which causes the piston 25 to be displaced. Thus, this will also enable the valve to be latched in an open position.

The aforementioned problems are solved in accordance with the present invention by arranging a close-able ventilating passage from the inlet, through which undesirable overpressure can be equalized. This can be effected, for example, in the manner illustrated in FIGS. 5 and 6. In the embodiment illustrated in FIGS. 5 and 6, the spring 9 is unable to provide complete closure of the valve 5, but a narrow opening gap will remain until the outer plunger 12 urges the valve 5 into sealing abutment with the valve seating 6. This is achieved by arranging on the valve spindle 7 a shoulder 29 against which the movable washer 11 will be urged when the spring 9 attempts to close the valve. The shoulder shall be located at a distance from the end of the valve spindle 7 such that complete closure of the valve 5 cannot be obtained as a result of the action of the spring. Subsequent to interrupting the incoming flow of petrol, the remaining overpressure at the inlet 2 can be equalized through the gap which remains. Subsequent to this equalization of the remaining overpressure, the piston 25 will return and draw up the rollers 19 out of engagement with the inner plunger 14. Thus, the valve cannot be reopened until the pump has been reactivated.

Figure 6:
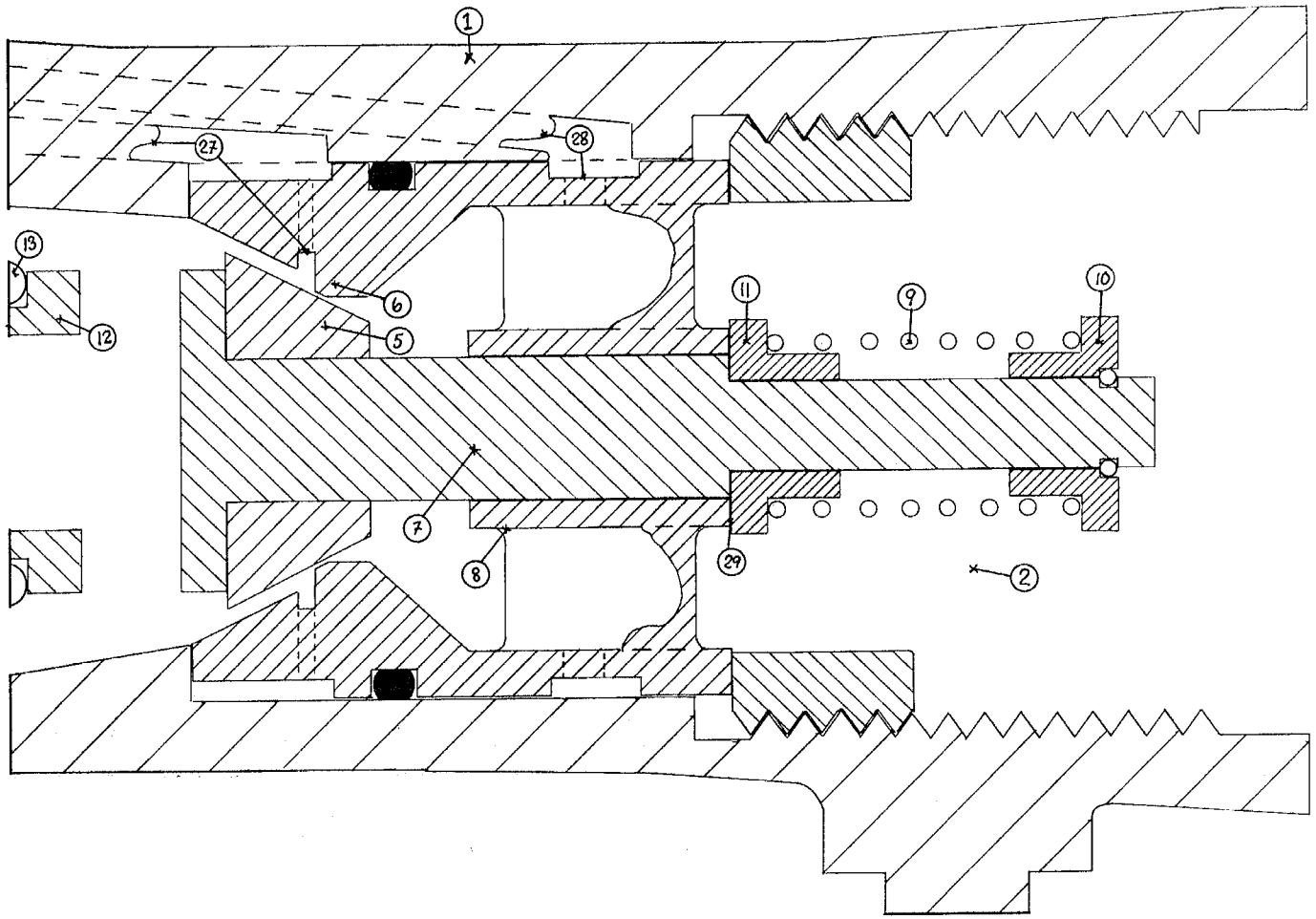
FIG. 6 illustrates the valve in a ventilating position.

If the pistol valve is closed by automatic disengagement or as a result of the handle 15 being released whilst the pump is still activated, an overpressure will be enclosed in the hose between the pump and the valve 5. This pressure will be sufficient to urge the piston 25 downwards thus permitting the valve to open. In the embodiment of FIGS. 5 and 6, however, cessation of the abutment of the outer plunger 12 with the spindle 7, as a result of depressing the handle 15, causes the aforementioned overpressure to open the valve 5 in a manner such as to form the previously mentioned gap between the valve 5 and the valve seating 6 for equalizing the overpressure at the inlet 2. This equalization of the pressure takes place very quickly, whereafter the piston 25 is again urged upwardly by the spring 24. The piston then withdraws the rollers 19 out of engagement with the inner plunger 14, whereupon the valve is again closed. No overpressure prevails, however, at the inlet 2.

As will be evident from the aforegoing, with the embodiment illustrated in FIGS. 5 and 6, the enclosure of an overpressure is prevented when the valve 5 closes slowly, or an enclosed overpressure is quickly equalized when an attempt is made to open the valve.

Figure 7:
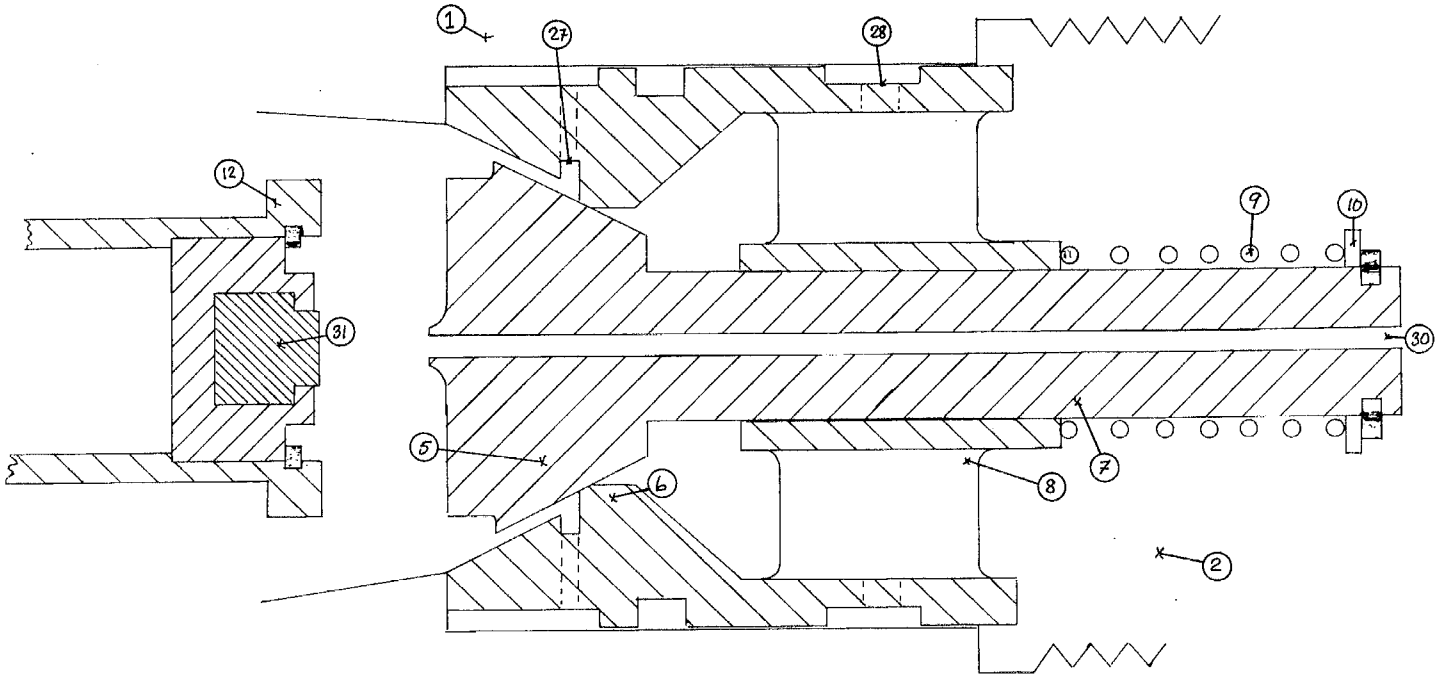
FIG. 7 illustrates an alternative embodiment for equalizing the overpressure at the inlet in conjunction with closing the valve.

Another method of equalizing the pressure is illustrated in FIG. 7. In this embodiment, the valve spindle 7 is provided with a through passing channel 30, through which the overpressure at the inlet can be equalized subsequent to interrupting the incoming flow of petrol. This channel is subsequently sealed in conjunction with the return of the outer plunger 12, by means of a rubber body 31 mounted on the end of the outer plunger.

The requisite equalization of the overpressure at the inlet can also be realised in other ways, the only requirement being that said equalization shall take place or be possible at all positions, in which the outer plunger 12 does not urge the valve 5 into sealing abutment with the valve seating 6. Thus, opening and closing of the ventilating channel can be controlled by the movement of the plunger 12 in the manner desired.

Figure 8:
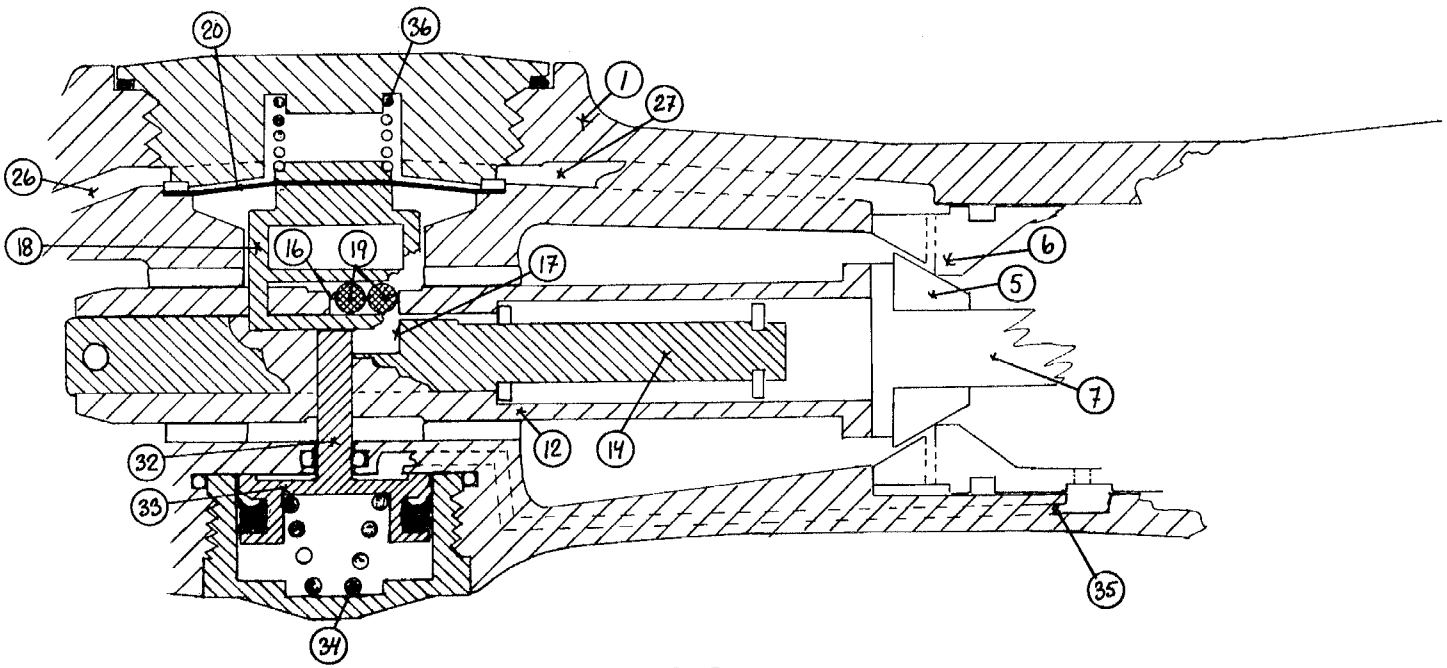
FIG. 8 is an axial sectional view of an alternative embodiment of a pistol valve according to the invention.

FIG. 8 illustrates schematically an alternative embodiment of the arrangement according to the invention, said arrangement being based on the same principle that the opening and closing of the valve 5 is dependent upon the pressure prevailing at the inlet 2. As with the earlier embodiments, a diaphragm 20 is attached to the holder 18 for defining a chamber above the diaphragm which can be used to automatically deactivate the pump in dependence upon the level of the liquid in the tank. In this embodiment, however, the holder 18, in the illustrated position, rests on an impact rod 32 which is connected with a piston 33. The piston 33 is biased towards its upper position by means of a spring 34. A pressure channel 35 from the inlet of the pistol valve opens into the chamber above the piston 33. This means that when an overpressure prevails at the inlet 2, the piston 33 will be pressed downwardly, which enables the holder 18 with the rollers 19 to be pressed down into engagement with the inner plunger 14 by a spring 36, provided that the recesses in the plungers 12 and 14 are located opposite one and other. Thus, the function of the embodiment illustrated in FIG. 8 is exactly the same as the function of the previously described arrangement.

Figure 9:
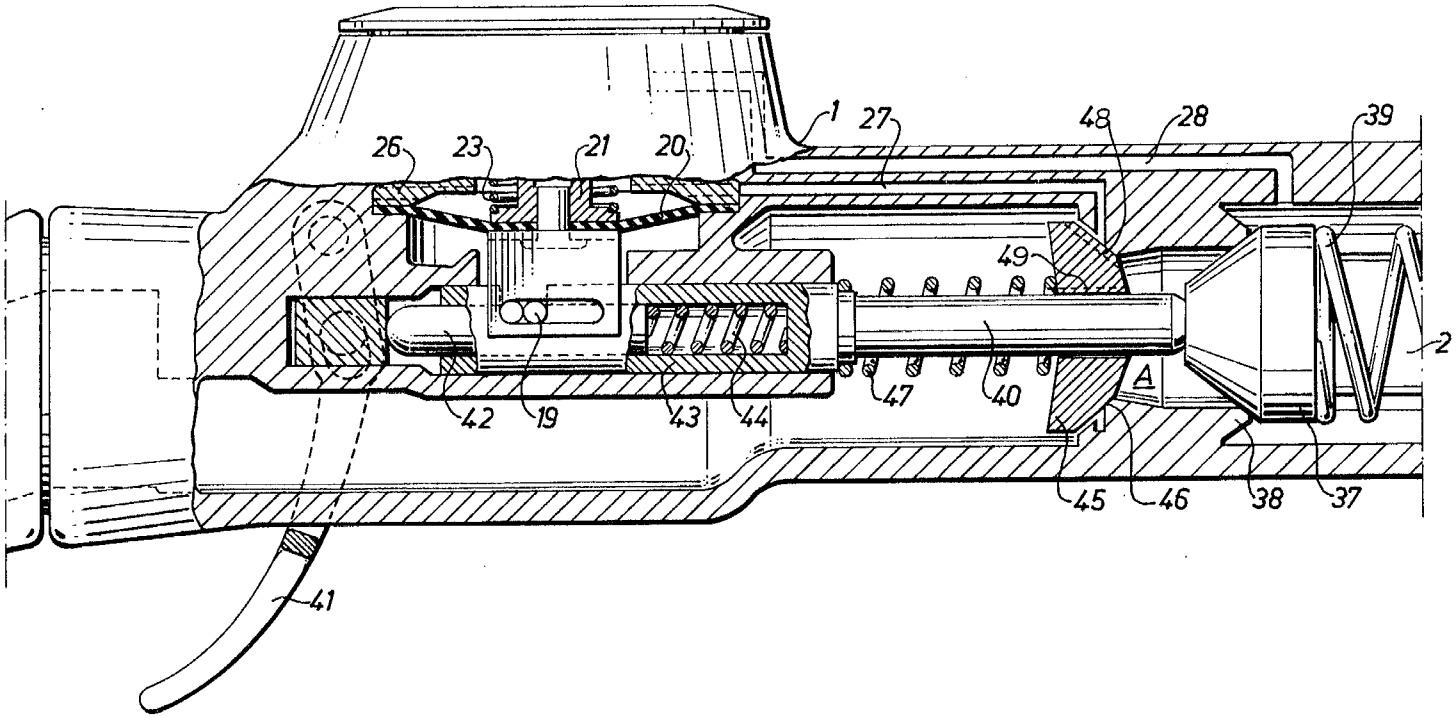
FIG. 9 illustrates a further embodiment, partly in section, of a pistol valve provided with pressure equalization according to the invention.

FIG. 9 illustrates the manner in which an equalization of the overpressure at the inlet 2, as disclosed in connection with the description of FIGS. 5–7, can be obtained in a pistol valve which opens against the flow of fluid unlike the embodiments described above which all open in the direction of the flow. Details common with the previous embodiments have the same reference numerals as in the previous Figures. According to FIG. 9, the main valve comprises a valve cone 37 which seals against a valve seat 38. The valve 37 is urged against the seat 38 by the pressure at the inlet 2 and by a spring 39. The valve can be opened by means of an impact rod 40 which is displaced by means of a handle or trigger 41. However, this presupposes that the rollers 19 are in an engagement position so that the displacement of an inner plunger 42 by means of the trigger 41 results in an outer plunger 43 connected with the impact rod 40 is caused to accompany the movement of the plunger 42. If the rollers 19 are not in the engagement position the inner plunger 42 will be displaced under compression of a spring 44 and the valve will remain closed.

The reference numeral 45 relates to a valve cone abutting a valve seat 46, the valve 45 being opened by the pressure at the inlet 2 against the action of a spring 47 when the main valve 37 is open. When the flow is decreasing, the spring 47 will adapt the opening of the valve 45 so that a sufficient pressure is maintained at the inlet 2 for keeping the rollers 19 in the engagement position. Thus, the spring 47 works in the same way as the spring 9 in the embodiment according to FIGS. 1–7.

The channels 26, 27 and 28 correspond directly to the channels having the same reference numerals in the previous embodiment, and the operation in connection with full tank, pump turn-off, and closing the valve by releasing the trigger is in principle the same as in the previous embodiment.

To obtain the required equalization of the overpressure at the inlet a slot or channel 48 or 49 can be arranged in the sealing surface of the valve 45 facing the valve seat 46 or the impact rod 40 as indicated in FIG. 9. It is essential only that communication is obtained between chamber A between the valves 37 and 45 and the space down stream of the valve 45. Of course this can be obtained in other ways, for instance by drilling a hole through the valve 45 or the impact rod 40, or by designing the valve 45 such that a poor sealing is obtained against the valve seat 46 or the impact rod 40.

The invention can also be modified in other respects within the scope of the claims and within the basic principle of the invention, meaning that the opening and closing functions of the valve shall take place in dependence upon the pressure at the inlet and that a ventilation channel for equalizing an overpressure at the inlet shall be obtained. Thus, the holder, for example, with said rollers can be replaced by any optional type of release arrangement, for example a pivotable hook or the like. Neither is the device according to the invention limited to use when filling the tank of a vehicle with fuel, but can also be used for dispensing any liquid with or without the use of an automatic protection against overfilling.

In all the aforedescribed embodiments the inlet pressure acts on a piston, which provides good response and reliability. With the previously used diaphragms, there is always the risk that the diaphragms will disintegrate when they are made of a thickness which will provide for good response required. Consequently, it is necessary for the diaphragms of prior art valves to be made thicker, which makes them very insensitive to variations in pressure, particularly at low temperatures.

Since all the disadvantages mentioned in the introduction are eliminated with a device constructed in accordance with the invention, arrangements for latching the handle can also be applied in pistol valves for self servicing pumps and for pumps used in connection with cash petrol dispensers.

I claim:

1. A liquid dispensing device in the form of a pistol valve, comprising:

a valve housing having an inlet connected to a pump, and an outlet; a valve for controlling the flow of liquid from the inlet to the outlet; a discharge pipe connected to said outlet; and a manually operable operating mechanism for controlling movement of said valve, said operating mechanism including adjustable means movable between an engagement position and a free position, wherein the movement of said adjustable means between said free position and said engagement position occurs in dependence upon the pressure of the liquid at said inlet, and wherein means are provided for equalizing an overpressure at said inlet:

(a) when the pump is deactivated when the valve is open, or (b) if an attempt is made to open the valve when the pump is deactivated and said pressure is sufficient to move said adjustable means;

said valve being arranged to open against the flow of fluid.

2. A device according to claim 1, wherein the pressure of the liquid at said inlet acts on a piston connected to said adjustable means.

3. A device according to claims 1 or 2, wherein said means for equalizing said overpressure at said inlet includes at least one ventilating passage, and means for closing said passage.

4. A device according to claim 1, in which said adjustable means includes a movably arranged holder which carries rollers, wherein said holder exerts a force on the rollers upon the occurrence of an overpressure of a given magnitude at said inlet, said force urging said rollers toward the engagement position.

5. A device according to claim 4, further comprising a spring adapted to return the rollers to the free position when the pressure at said inlet falls below said magnitude.

6. A device according to claim 1, wherein said valve in the open position adjusts the opening area in dependence upon the incoming flow of liquid, thereby maintaining a given pressure at the inlet when the pump is activated.

7. A device according to claim 6, wherein the valve is opened by the pressure at the inlet against the action of a second spring which determines said given pressure magnitude.

8. A device according to claim 7, wherein the valve is constructed so that when said second spring tends to completely close the valve because the flow of incoming liquid has ceased, there is obtained a narrow ventilating passage for equalizing the pressure at said inlet.

9. A liquid dispensing device in the form of a pistol valve, comprising:

a valve housing having an inlet connected to a pump, and an outlet; a valve for controlling the flow of liquid from the inlet to the outlet; a discharge pipe connected to said outlet; and a manually operable operating mechanism for controlling movement of said valve, said operating mechanism including adjustable means movable between an engagement position and a free position, wherein the movement of said adjustable means between said free position and said engagement position occurs in dependence upon the pressure of the liquid at said inlet, said pressure being arranged to act on a piston connected to said adjustable means, and wherein said valve is arranged to open against the flow of fluid.

* * * * *